United States Patent [19]

Howells

[11] Patent Number: 4,958,466

[45] Date of Patent: Sep. 25, 1990

[54] EXHAUST GAS MEDIA SEPARATOR WITH RECYCLING AND DUST COLLECTION

[75] Inventor: Roger A. Howells, Orefield, Pa.

[73] Assignee: Air Products and Chemicals, Inc., Allentown, Pa.

[21] Appl. No.: 323,537

[22] Filed: Mar. 14, 1989

[51] Int. Cl.[5] ..... B24C 9/00

[52] U.S. Cl. ..... 51/425; 51/426

[58] Field of Search ..... 51/425, 424, 426, 436, 51/410, 319, 322

[56] References Cited

U.S. PATENT DOCUMENTS

| | | | |
|---|---|---|---|
| 3,279,125 | 10/1966 | Leliaert | 51/425 |
| 3,378,959 | 4/1968 | McCormick, Jr. | 51/426 |
| 4,524,550 | 6/1985 | Burke et al. | 51/424 |
| 4,648,214 | 3/1987 | Brull et al. | 51/425 |

FOREIGN PATENT DOCUMENTS

| | | | |
|---|---|---|---|
| 3338980 | 5/1985 | Fed. Rep. of Germany | 51/425 |
| 0686200 | 4/1930 | France | 51/424 |
| 0902990 | 8/1962 | United Kingdom | 51/426 |

*Primary Examiner*—Robert A. Rose

*Attorney, Agent, or Firm*—James C. Simmons; William F. Marsh

[57] ABSTRACT

A method and apparatus for withdrawing gas at cryogenic temperatures from a blast-treating chamber and thereafter separating the entrained blast media and dust from the cryogenic carrier gas so the cryogenic gas can be recycled back to the blast-treating chamber.

3 Claims, 2 Drawing Sheets

EXHAUST GAS MEDIA SEPARATOR WITH RECYCLING AND DUST COLLECTION

FIELD OF THE INVENTION

The present invention pertains to shot-blasting or blast cleaning of surfaces that have been coated such as by painting. In particular the present invention is concerned with cleaning and recycling of a cold carrier gas used in the blast treating chamber with minimized loss of refrigeration in the cold recycled gas.

BACKGROUND OF THE INVENTION

U.S. Pat. No. 4,524,550 discloses and claims an apparatus for removing flash from molded plastic and elastomeric articles and paint or coatings from various articles by contacting these with a blast media entrained in a cold carrier gas. The process operates by using the cold carrier gas, usually at cryogenic temperatures to embrittle the flash or coating on the articles. The embrittled flash or coating being removed by the impact of the entrained solid particles which are in the form of shot, pellets or irregular shaped particles. In one particular process, generally referred to as Cryogenic Coating Removal (CCR), hangers used on a paint line in a manufacturing operation eventually become coated with many layers of paint which have to removed. By placing these hangers in a device such as shown in the '550 patent and having the hanger contacted by particulate material (e.g., polycarbonate plastic) entrained in a nitrogen gas maintained at a temperature of between −150° F. to −225° F. (−101° C. to −143° C.) the layers of paint can be embrittled and removed.

In the device of the '550 patent the blasting particles and the coating or flash are collected in the bottom of the device, cleaned and recycled. In the apparatus of the '550 patent the carrier gas is normally vented through a tall stack. The use of a tall stack provides a means for removing particles entrained in the cold carrier gas as it exits the insulated chamber because of the velocity change as the exhaust gas ascends the chimney.

The problem with exhausting the cold gas is that it leads to an inefficient operation because a great deal of refrigeration value in the gas is lost in the exhaust. In addition, the media and particles that enter the exhaust system must be cleaned from that system regularly. Furthermore, dust or fine particles generated from the process collects on the media and can be discharged into the atmosphere since the dust particles are not heavy enough to fall back into the stack as the cold carrier gas exits the exhaust system. Another problem with using the exhaust only system is that in order to open the door to the blast treating chamber (e.g., at the end of a cleaning cycle) the exhaust system had to be turned off and when the door was open the area around the chamber door was usually bathed in dust which escaped from the chamber. Attempts to ameliorate this condition centered around putting a small collector in the exhaust system which was allowed to run for 30 to 40 seconds before the door was open to attempt to eliminate the dust.

Attempts to solve the problem centered around the use of screens in the exhaust opening. However, these have been ineffective because screens which would stop the media tend to become easily clogged and must be cleaned on a regular basis.

A cyclone separator wherein the gases are spun and then separated until the heavy particles fall to the bottom to be collected and manually returned to the blast treating chamber has been used. However, the cyclone devices must be drained of media and dust and because of its placement can be marginally effective and used only on waste gases which are then exhausted to the atmosphere. The materials reclaimed from the cyclone must be screened to remove the fines and the reusable media manually returned to the blast treating chamber. Additionally some of the media and the (fines) dust can escape through the cyclone. Another problem with cyclone separators is that by their action they utilize the inertial energy of the entrained media particles reinforced by the gas velocity to separate the media particles from the exhaust gas stream. Cyclones are bulky units and in order to work well they must be designed for a particular flowrate. If the exhaust gas flowrates are reduced, insufficient velocity of the gas will allow the media particles to fall out in the connective piping and thereby block the exhaust flow. When this happens the piping must be disassembled and the entire system cleaned before it can be reused.

The complete removal of dust from the system on a continuing basis has not been attempted before. The only attempt, as set out above involved use of a dust collector prior to opening the door at the end of the blast cycle during the coast down time of the throwing wheels in the blast chamber while at the same time preventing the door from being opened. The collector was an uninsulated unit since there was no concern about the unit being subjected to cryogenic temperatures.

There have been no attempts to recycle the cold gas to recover the refrigerative capacity of the gas prior to exhausting to the atmosphere.

SUMMARY OF THE INVENTION

The present invention is an accessory to the device shown in U.S. Pat. No. 4,524,550. The present invention includes an insulated enclosure which can be connected to the blast treating chamber so that the cold carrier gas can be withdrawn from the blast treating chamber by a large exhaust fan. The cold carrier gas being withdrawn from the blast treating chamber contains entrained blast media as well as fine particles and/or dust. The apparatus of the invention includes means for achieving a velocity loss of both the blast media entrained in the cold carrier gas and the cold carrier gas itself. The blast media is thus separated from the exhaust gas and can be collected in a hopper disposed within the apparatus. The hopper can contain means (e.g., a motorized auger) to return the media to the blast chamber for recycle.

In the apparatus of the present invention the exhaust gas drawn by a large fan then proceeds through a dust collector (e.g., baghouse) and through a conduit for recycling back to the blast chamber to recover the refrigerative capacity of the gas. The media and dust collection systems are operated continuously during the blast cleaning cycle to remove all of the dust generated by the operation thus preventing dust from building up in the system and also from being exhausted to the atmosphere. The device of the present invention includes a counter-balanced waste gate valve located downstream of the dust collection device to permit excess cleaned waste gas to exit from the system to the atmosphere to prevent an undue pressure buildup in the closed system.

DETAILED DESCRIPTION OF THE INVENTION

Figure 1:
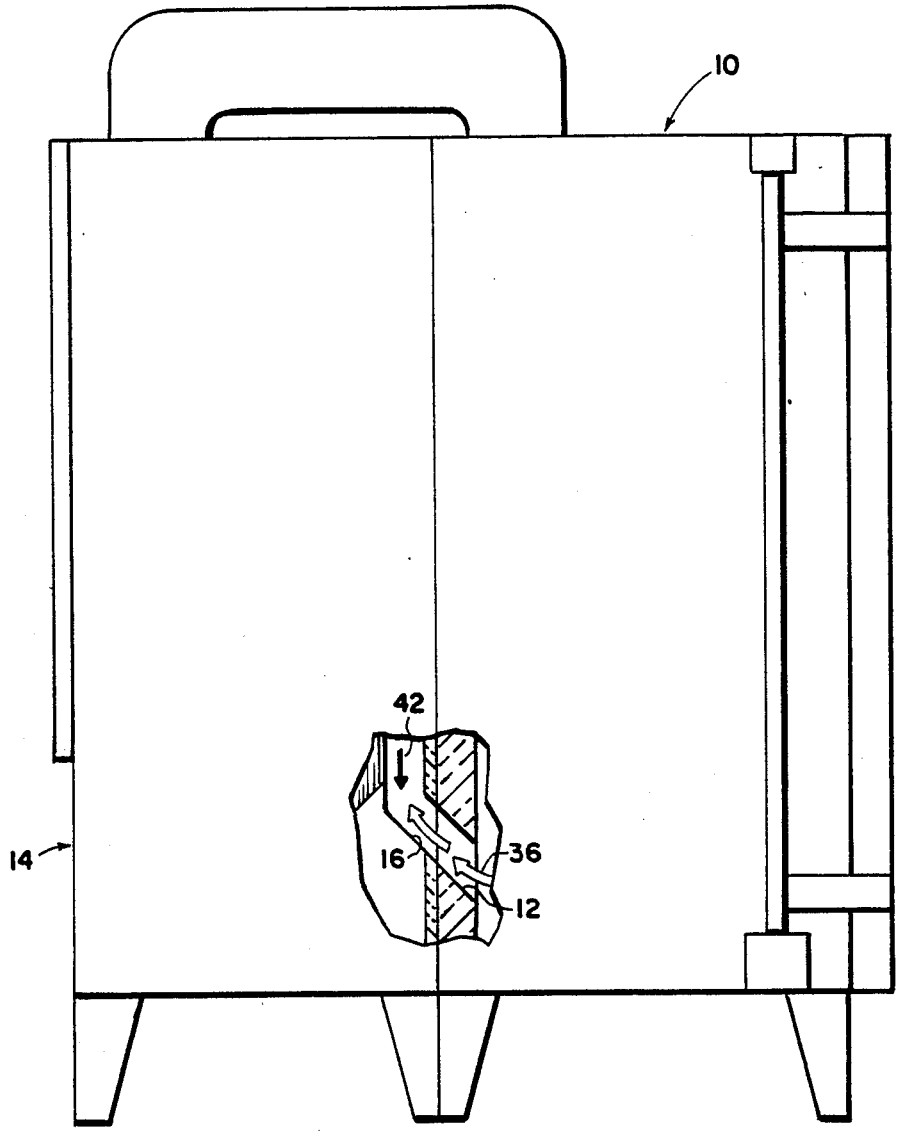
FIG. 1 is a side elevation view of the apparatus of the present invention as shown in association with a blast treating chamber.

Referring to the drawing and in particular FIG. 1 numeral 10 designates a blast treating chamber such as disclosed and claimed in U.S. Pat. No. 4,524,550 the specification and drawing thereof being incorporated herein by reference. Blast treating chamber 10 is modified so that the normal exhaust system is replaced so that there is a duct or passage 12 communicating with an insulated enclosure shown generally as 14 which is an apparatus according to the present invention. An insulated enclosure 14 includes a inlet duct 16 which is complimentary to the exhaust duct 12 of a blast treating chamber 10.

In referring to the insulated enclosure 14 the insulation is such that there is minimal loss of the temperature of the cold gas exiting blast treating chamber 10 as it circulates through the insulated enclosure 14. Conventionally, insulated enclosure 14 is manufactured from a poor conductive material such as stainless steel which is also an effective structural material for use at cryogenic temperatures and is of a doublewall construction to permit insulation thereof.

Figure 2:
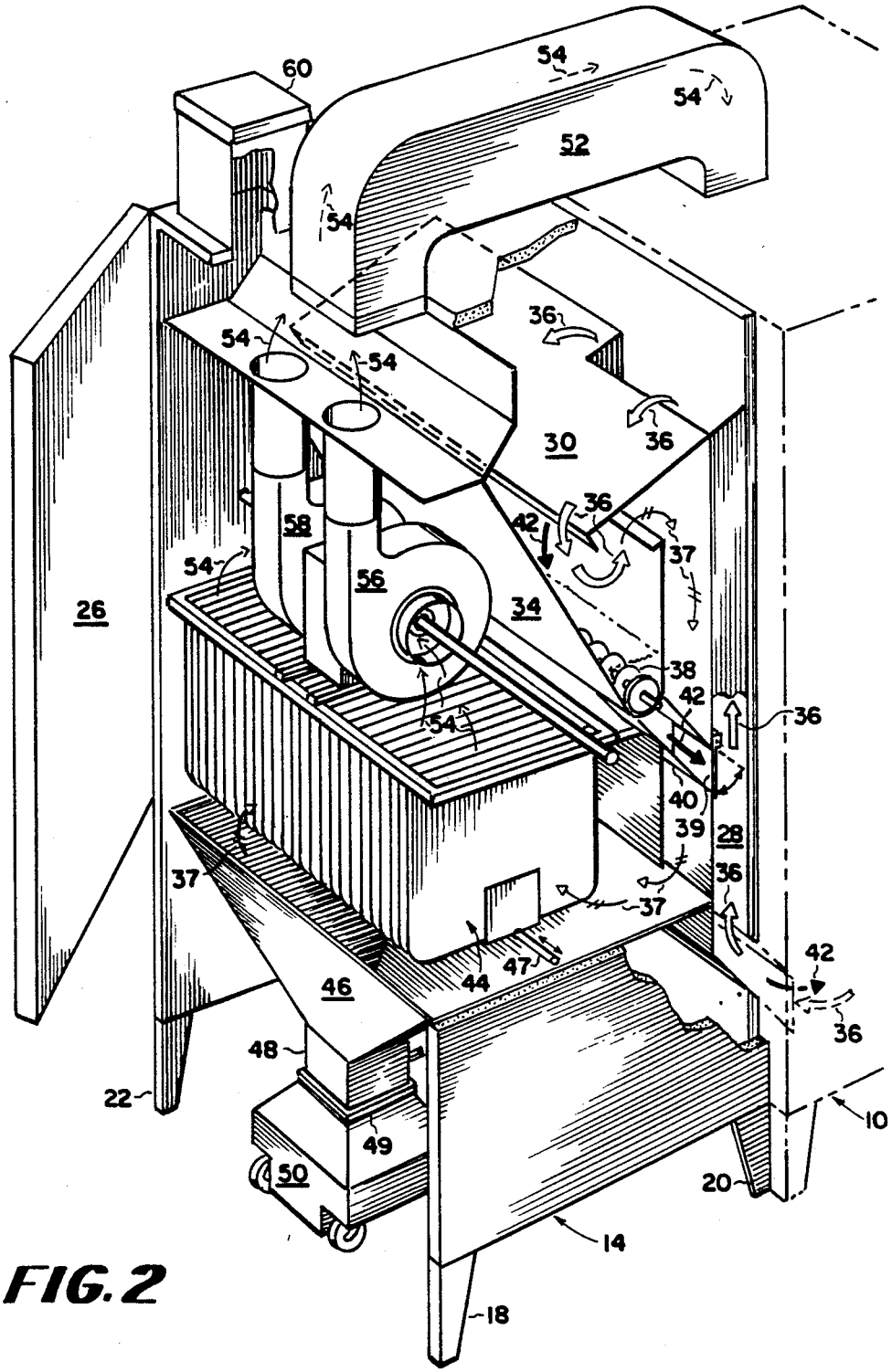
FIG. 2 is a isometric view of the device of the present invention with portions broken away to show interior details thereof.

Referring to FIG. 2, insulated enclosure 14 contains suitable support members 18, 20, 22 and 24 (not shown) so that the entire enclosure 14 can be free-standing. Alternatively, it can be made to be fastened directly to one side of the blast treating chamber 10. Insulated enclosure 14 contains an access door 26 so that the interior of the enclosure 14 can be exposed for servicing of the internal parts, cleaning, etc.

Insulated enclosure 14 includes as part of the inlet 16, an inlet conduit or chute 28 which communicates with a system of baffles 30, 32 and a generally "V" shaped hopper 34 to direct the cold gas containing media and dust in the direction shown by the hollow arrows 36. The baffles 30, 32 and hopper 34 serve to achieve a velocity loss of both the blasting media entrained in the cold exhaust gas and the cold exhaust gas itself so that the blasting media drops out of the cold exhaust gas and collects in the hopper 34. The collected blast media in hopper 34 is removed via a device such as a screw auger 38 which moves the media to a drop chute 40 in the direction shown by arrows 42 for return to the normal media collection receptacle of the blast treating chamber 10 for reuse in the blast treating chamber 10. The cold gas from which substantially all of the blast media has been removed (shown by arrows 37) still contains fine particles of media or dust or the like and is conducted through a dust collection (separation) apparatus shown generally as 44. The dust collection apparatus can be a conventional baghouse type filter system or other particulate filter system as is known in the art. The baghouse system 44 includes the conventional shaker (47) hopper 46, transition chute 48 and collection device 50 so that dust and other fine particles removed in the baghouse system can be collected in the receptacle 50 and removed periodically without permitting heat leaking into the refrigerated enclosure 14. The dust collecting portion of the invention includes a pneumatic seal 49 for the waste dust canister 50 and a drive mechanism (not shown) mounted outwardly of the cabinet for the dust bag shaking system. The cold carrier gas cleaned of blasting media and fine particles is conducted to the recycle duct 52 as shown by arrows 54. Recycle duct 52 is connected to the blast treating chamber 10 so that the colder gas is recycled to blast treating chamber 10 to recover the refrigerative value of the gas. Movement of the cold carrier gas and particles through the insulated enclosure 14 is accomplished by a blower system containing dual blowers 56, 58 which provide the flow momentum for the cold carrier gas throughout this system. As part of the exhaust system there is included a vent mechanism 60 in the form of a counterbalanced waste gate to permit excess clean waste gas to exit the system into the atmosphere. The waste gate is set, because fresh cryogen is constantly added to the blast treating chamber 10, to maintain a gas pressure of approximately two inches of water pressure in the system.

Thus it can be seen that the method apparatus of the present invention provides for dissipation of the inertial energy of the blast treating media by non-destructive physical contact with baffles contained in the insulated chamber while at the same time expanding the area through which the exhaust gas flows to reduce the gas velocity to a point where it will no longer carry the blast media particles entrained therein. A collecting hopper with a return auger eliminates the manual collection and reclaim (return to blast treating chamber) tasks that had to be manually provided for in prior art methods and devices.

In addition dust from the operation is eliminated in the dust collector or baghouse to permit recycle of a clean cold carrier gas to extract the refrigerative capacity of the gas prior to exiting from the system as a clean exhaust gas.

Having thus described my invention what is desired to be secured by letters patent of the United States is set forth in the appended claims.

I claim:

1. An apparatus for recovering blasting media and separating dust from a cryogenic carrier gas for reintroduction into a blast treating chamber comprising in combination:

an insulated enclosure containing means to withdraw cold carrier gas with blasting media and other particles entrained therein from said blast treating chamber and introduce said withdrawn cold carrier gas and blasting media into an inlet in said insulated enclosure;

a system of baffles disposed in the path of said cold carrier gas containing entrained media to effect a velocity loss of said media causing said media to separate from said cold carrier gas and a hopper for collecting media said hopper containing means including a motorized auger communicating with a conduit which in turn is connected to said blasting media inlet in said insulated enclosure for returning said media to said blast treating chamber for reuse;

means within said insulated enclosure to remove fine particles entrained in said cold carrier gas;

means to return said cold carrier gas to said blast treating chamber in order to recover refrigeration from said cold carrier gas in said blast treating chamber; and means to exhaust excess cleaned carrier gas from said apparatus to ambient temperature.

2. An apparatus according to claim 1 wherein an inlet to introduce cold carrier gas with blasting media and other particles entrained therein into said insulated enclosure is also a duct adapted to be a return for reclaimed media from the insulated enclosure to a media collection receptacle in said blast treating chamber and an exhaust fan to move said cold carrier gas and blasting media from said inlet in said insulated enclosure through said enclosure toward exit means in said enclosure.

3. An apparatus according to claim 2 wherein said exit means includes a first conduit to recycle cleaned cold carrier gas to said treating chamber, and a gated exhaust port to vent excess cleaned cold carrier gas from said insulated enclosure.

* * * * *